US010533346B2

(12) United States Patent
Van Hellemont

(10) Patent No.: US 10,533,346 B2
(45) Date of Patent: Jan. 14, 2020

(54) MAGNETIC CHILD SAFETY LOCK

(71) Applicant: Kidzlock LLC, Farmington Hills, MI (US)

(72) Inventor: Robert Wilbur Van Hellemont, Naples, FL (US)

(73) Assignee: Kidzlock LLC, Farmington Hills, MI (US)

( * ) Notice: Subject to any disclaimer, the term of this patent is extended or adjusted under 35 U.S.C. 154(b) by 326 days.

(21) Appl. No.: 15/476,298

(22) Filed: Mar. 31, 2017

(65) Prior Publication Data

US 2018/0283052 A1 Oct. 4, 2018

(51) Int. Cl.
*E05B 65/00* (2006.01)
*E05B 17/00* (2006.01)
*E05B 65/46* (2017.01)

(52) U.S. Cl.
CPC ..... *E05B 65/0014* (2013.01); *E05B 17/0062* (2013.01); *E05B 65/46* (2013.01)

(58) Field of Classification Search
CPC ..... E05B 65/0014; E05B 17/0062; E05B 47/004; E05B 65/44; E05B 65/46; E05B 17/0066; E05B 47/0038; F16L 21/00
USPC ..... 292/138
See application file for complete search history.

(56) References Cited

U.S. PATENT DOCUMENTS 2,809,062 A 10/1957 Mainhardt
2,853,331 A 9/1958 Teetor
3,665,737 A * 5/1972 Reese ..... E05B 47/004 292/142
3,744,833 A * 7/1973 Berducone ..... E05B 47/0038 292/251.5
4,848,812 A 7/1989 Slaughter
5,421,623 A * 6/1995 Cassin ..... F16L 21/00 285/343
7,246,413 B2 * 7/2007 Portelli ..... A47B 95/02 16/414
7,331,617 B2 * 2/2008 Johnson ..... E05B 17/2019 292/202
8,726,704 B2 * 5/2014 White ..... E05B 37/20 109/48
2009/0250949 A1 * 10/2009 Sharpe ..... E05C 19/16 292/251.5
2015/0211258 A1 * 7/2015 Gokcebay ..... E05B 47/06 70/278.1

* cited by examiner

*Primary Examiner* — Nathan Cumar
(74) *Attorney, Agent, or Firm* — Brooks Kushman, P.C.

(57) ABSTRACT

A locking mechanism, for locking a closure having a closure side edge and a closure bore in the closure side edge relative to a frame having a frame side edge and a frame bore in the frame side edge is disclosed. The locking mechanism may include a locking member, a moveable magnet, and an actuating magnet. The moveable magnet may be attached to the locking member and may be configured to move within one of the closure bore and the frame bore such that the locking member may be moved so as to engage or disengage the other of the closure bore and frame bore. The actuating magnet may be configured to magnetically cooperate with the moveable magnet to move the locking member from a disengaged position into an engaged position and vice versa.

18 Claims, 2 Drawing Sheets

MAGNETIC CHILD SAFETY LOCK

TECHNICAL FIELD

The present disclosure relates to child safety locks and more specifically to a magnetic child safety lock that is designed to be retrofitted into existing closures, such as doors and drawers, or manufactured into new closures.

BACKGROUND

Unlocked closures, such as entrance, exit, interior, cupboard, or cabinet doors and drawers pose a danger to children that are out of the eyesight of a watchful parent. Even a door or drawer with an ordinary latch or rotatable knob can easily be opened by a child. In such instances, a child could be injured by leaving the home, entering an otherwise secure room, or by opening any such closures and ingesting or handling a harmful household product, medical product, chemical product, or dangerous implement or device stored within such a cupboard, cabinet, drawer, room, or other enclosed area. Parents and guardians are aware of such risks and have tried to mitigate those risks by securing closures, such as doors and drawers, with various locking mechanisms. However, existing methods are often cumbersome, may require modification of the existing latching system, and also may require breaking into the locked closure if the user is unable to unlock the locking mechanism.

SUMMARY

According to one embodiment of this disclosure, a locking mechanism, for locking a closure having a closure side edge, and a closure bore in the closure side edge, relative to a frame having a frame side edge, and a frame bore in the frame side edge, is disclosed. The locking mechanism may include a locking member, a moveable magnet, and an actuating magnet. The moveable magnet may be attached to the locking member and may be configured to move within one of the closure bore and the frame bore such that the locking member may be moved so as to engage or disengage the other of the closure bore and frame bore. The actuating magnet may be configured to magnetically cooperate with the moveable magnet to move the locking member from a disengaged position into an engaged position and vice versa.

According to another embodiment of this disclosure, a locking mechanism, for locking a closure having a closure side edge, and a closure bore in the closure side edge, relative to a frame having a frame side edge, and a frame bore in the frame side edge, is disclosed. The locking mechanism may include a housing sleeve, a locking member, a moveable magnet, and an actuating magnet. The housing sleeve may have a housing sleeve bore and may be disposed within one of the closure bore and the frame bore. The moveable magnet may be attached to the locking member and the moveable magnet and locking member may be configured to move within the housing sleeve bore such that the locking member may be moved so as to engage or disengage the other of the closure bore and frame bore. The actuating magnet may be configured to magnetically cooperate with the moveable magnet to move the locking member from a disengaged position into an engaged position and vice versa.

According to yet another embodiment of this disclosure, a locking mechanism, for locking a closure having a closure side edge, and a closure bore in the closure side edge, relative to a frame having a frame side edge, and a frame bore in the frame side edge, is disclosed. The locking mechanism may include a housing sleeve, a stop sleeve, a locking member, and a moveable magnet. The housing sleeve may be disposed within one of the closure bore and the frame bore. The stop sleeve may define a stop sleeve bore having a stop sleeve bore diameter or dimension and be disposed axially with the housing sleeve within the one of the closure bore and the frame bore such that the stop sleeve is nearer to other of the closure bore and the frame bore. The moveable magnet may be attached to the locking member and may be configured to move within the housing sleeve bore such that the locking member may be moved so as to engage or disengage the other of the closure bore and frame bore. The moveable magnet may have a moveable outermost magnet diameter or dimension greater than the stop sleeve bore diameter or dimension such that the stop sleeve acts as a stop to prevent the moveable magnet from being moved from the housing sleeve. The actuating magnet may be configured to magnetically cooperate with the moveable magnet to move the locking member from a disengaged position into an engaged position and vice versa.

DETAILED DESCRIPTION

As required, embodiments of the present invention are disclosed herein; however, it is to be understood that the disclosed embodiments are merely exemplary of the invention that may be embodied in various and alternative forms. The figures are not necessarily to scale; some features, and the gaps or spaces between some features, may be exaggerated or minimized to show details of particular components. Therefore, specific structural and functional details disclosed herein are not to be interpreted as limiting, but merely as a representative basis for teaching one skilled in the art to employ the present invention in various embodiments.

A magnetic lock for various household closures, such as doors and drawers, is disclosed herein. The magnetic lock may include an actuation magnet that cooperates with a moveable magnet attached to a locking member. The moveable magnet is magnetically moveable so as move the locking member from an unlocked position to a locked position and vice-versa. The actuation magnet may be disposed within a structure, such as knob, cabinet pull, or handle, to make it easier to handle and more aesthetically pleasing. The actuation magnet is capable of being removed from magnetic engagement with the moveable magnet such that the actuation magnet can be stored in a different location to prevent a child from attempting to use the actuation magnet to open the closure. In certain embodiments, the locking member may be designed to break when in the locked position if a predetermined force is applied to the closure. Accordingly, if the actuation magnet cannot be located or is no longer capable of unlocking the mechanism, the closure may still be opened by pushing or pulling on the door or drawer with a predetermined force sufficient to break the locking member. In other embodiments, the locking member may be detachably connected to the moveable magnet via Velcro, any other suitable hook and loop fastener, or similarly detachable fastener. The detachable fastener makes it possible to replace an old, inoperable, or broken locking member with a new locking member.

Figure 1:
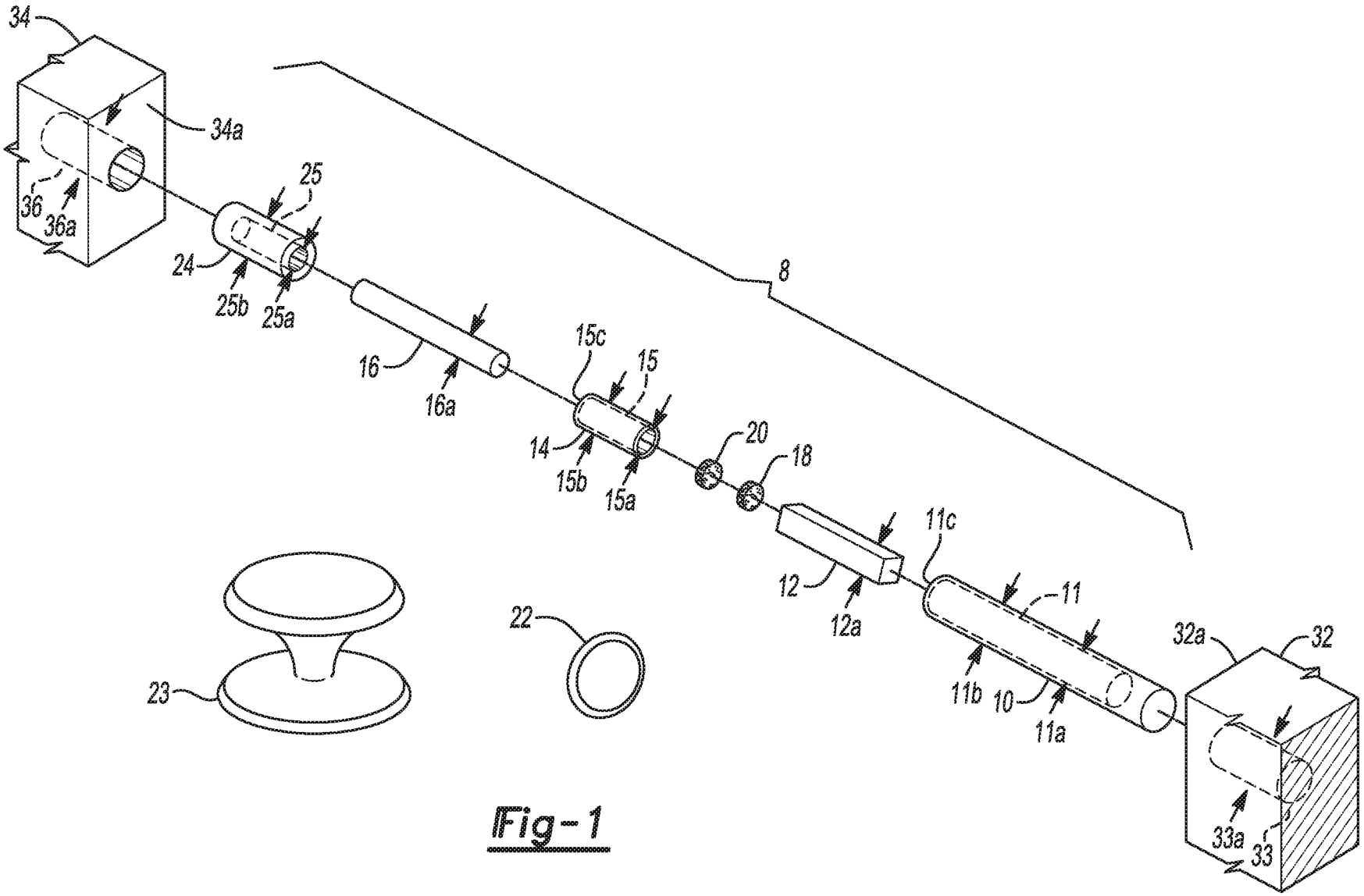
FIG. 1 is an exploded perspective view of the magnetic lock according to one embodiment.
Figure 2:
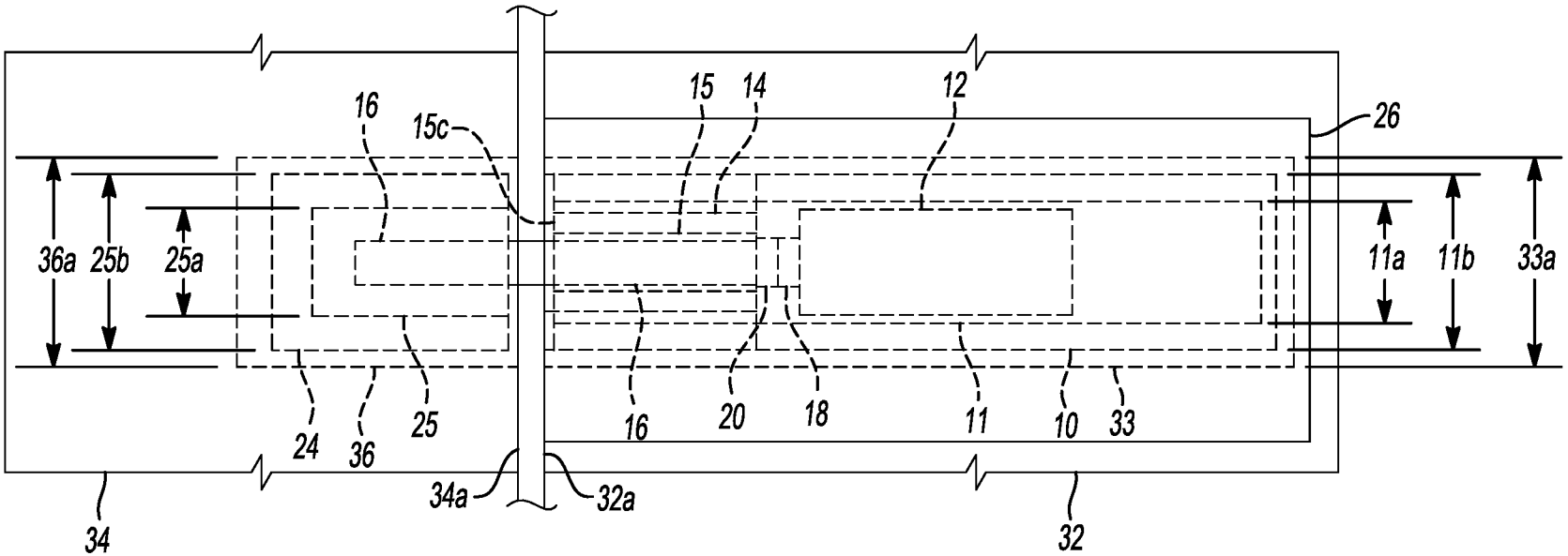
FIG. 2 is a plan view of a magnetic lock according to one embodiment installed within a closure, such as a door or drawer.

Referring to FIG. 1, an exploded view of one embodiment the magnetic child safety lock, and FIG. 2, a plan view of the same embodiment as installed, is illustrated. In accordance with this embodiment, the lock 8 includes a housing sleeve 10 and a stop sleeve 14. Both sleeves 10 and 14 have a tubular configuration such that the housing sleeve 10 defines a housing sleeve bore 11 having a bore diameter or dimension 11*a* and the stop sleeve 14 defines a stop sleeve bore 15 having a stop sleeve bore diameter or dimension 15*a*. While the housing sleeve bore 11 could extend through the entire housing sleeve 10, it is preferable that it does not, as shown in FIGS. 1 and 2. The housing sleeve 10 has an outer diameter or dimension 11*b* while the stop sleeve 14 has an outer diameter or dimension 15*b*. The stop sleeve outer diameter or dimension 15*b* is smaller than or approximately equal to the housing sleeve bore diameter or dimension 11*a* such that the stop sleeve 14 can be inserted into, and preferably fixed, within the housing sleeve bore 11 by any suitable manner, such as via a pressure or friction fit, adhesive, or a fastener. Because of these preferred dimensional relationships, the stop sleeve bore 15 is smaller than the housing sleeve bore diameter or dimension 11*a*. However, other suitable dimensional relationships could be used. In the embodiment shown, each of the housing sleeve 10, housing sleeve bore 11, stop sleeve 14, and stop sleeve bore 15 has an elongated cylindrical tubular configuration. Elongated means the object has a length that is longer than the width of the object. However, any other suitable configurations or shapes could be used. For example, each could have a shorter non-elongated configuration and each could have a non-cylindrical configuration, such as a configuration having a hexagonal, square, rectangular or other suitable cross-section.

The housing sleeve 10 and stop sleeve 14 may be made from plastic or any other suitable material. As shown in this embodiment, the housing sleeve 10, together with the inserted stop sleeve 14, are disposed within a closure bore 33 defined within a side edge 32*a* of closure 32. As used herein, the term "closure" may include any door, such as any exterior, interior, or cabinet door, or any other structure or member that is moveable to allow access to an enclosed area, such as the exterior face of a drawer or a drawer front. The closure bore 33 can be formed, such as by drilling, by a person desiring to utilize a lock 8. While a cylindrically-shaped bore 33 is preferable, and the easiest to form by a user, any suitable closure bore 33 configuration could be used. The closure bore 33 preferably has a closure bore dimension or diameter 33*a* equal or approximately equal to the housing sleeve outer diameter or dimension 11*b* such that the housing sleeve 10 may be easily fixed within the closure bore 33 by any suitable manner, such as via a pressure or friction fit, adhesive, or a fastener.

The housing and stop sleeves 10 and 14 are preferably arranged so that the housing sleeve and stop sleeve bores 11 and 15, although having different diameters, are aligned axially to each other. The housing sleeve 10, together with the inserted stop sleeve 14, may preferably be disposed such that the housing sleeve end 11*c* and stop sleeve end 15*c* nearest the side edge 32*a* of the closure 32 is very near or aligned with the side edge 32*a* of the closure 32. However, the housing and stop sleeves 10 and 14 could be disposed in any suitable manner. For example, the housing and stop sleeves 10 and 14 could be disposed such that the ends 11*c* and 15*c* nearest the side edge 32*a* of the closure 32 are not aligned with or very near the side edge 32*a* of the closure 32 but instead are further within the closure 32. As shown in this embodiment, the housing sleeve 10 is longer than the stop sleeve 14. However, any suitable dimensional relationships could be used that would allow a moveable magnet 12 to move within the housing sleeve bore 11 as described below.

More specifically, a moveable magnet 12 is disposed within the housing sleeve bore 11 and is preferably attached to a locking member 16 as explained further below. The moveable magnet 12 may be made of a Neodymium magnetic material or any other suitable magnetic material. The moveable magnet 12 has an elongated shape having a moveable magnet outermost diameter or dimension 12*a* less than the housing sleeve inner diameter or dimension 11*a* such that the moveable magnet 12 can be moved, such as slidably moved, within the housing sleeve bore 11. The outermost diameter or dimension 12*a* of the moveable magnet 12 is greater than the stop sleeve bore diameter or dimension 15*a* of the stop sleeve 14. Because the outermost diameter or dimension 12*a* of the moveable magnet 12 is larger than the stop sleeve bore diameter or dimension 15*a*, the stop sleeve 14 prevents the moveable magnet 12 from being overextended and moved out of the housing sleeve bore 11 of the lock 8 after being fully assembled within the closure door 32.

The moveable magnet 12 is preferably connected in any suitable detachable manner to the locking member 16. For the purposes of this disclosure, connecting the moveable magnet 12 to the locking member 16 in a detachable manner means the two components can be disconnected without permanently damaging either the moveable magnet 12 or locking member 16. Preferably the moveable magnet 12 and locking member 16 may be disconnected by a user applying an axial force on the locking member 16, or to a broken piece of the locking member 16 still connected to the moveable magnet, so as to disconnect the locking member 16, or locking member 16 piece, from the moveable magnet 12. For example, a first detachable fastener member 18 may be disposed on the end of the moveable magnet 12 that is disposed closest to the locking member 16 via a suitable adhesive or in any other suitable manner. The first detachable fastener 18 cooperates with a second detachable fastener member 20 that is disposed on the end of the locking member 16 that is disposed closest to the moveable magnet 12 via a suitable adhesive or in any other suitable manner such that the moveable magnet 12 can be attached in a detachable manner to the striker or locking member 16. The first detachable fastener 18 may be one of a hook or loop Velcro component, or any other suitable hook and loop fabric fastener, or any other suitable detachable fastener. The second detachable fastener 20 may be the other, mating, one of a hook or loop Velcro component, or any other suitable hook and loop fabric fastener, or any other suitable detachable fastener.

As can be seen in the embodiment shown in FIGS. 1 and 2, the locking member 16 has an outer dimension or diameter 16*a* and an elongated-cylindrical shape. However, any other suitable configurations or shapes could be used. The locking member outer dimension or diameter 16*a* is less than the stop sleeve bore inner diameter or dimension 15*a* such that the locking member 16 can be moved, such as slidably moved, within the stop sleeve bore 15. The locking member 16 may be made from plastic or any other suitable material. However, it is preferable that the locking member 16 be made of a material having a shear or shatter strength such that, as will be explained further, the locking member 16 will break while in the engaged or locked position if a predetermined force, such as a force that could be generated by an "adult" user, is applied in an effort to open the closure 32. It has been determined that a locking member 16 that will break as the result of such a predetermined force ranging from 100 pounds to 150 pounds is suitable, although other ranges could also be suitably employed As will also be explained further, this will allow an adult user to open the closure 32 in the event the locking member 16 cannot be disengaged from an engaged or locked position, if an actuating magnet 22 cannot be found, or for any other reason. A suitable material for the locking member 16 would include an acrylic plastic or an acrylic glass, such as poly(methyl methacrylate) (PMMA), that shatters when a predetermined force is applied. PMMA may also be known as trade names such as Plexiglas, Acrylite, Lucite, and Perspex among several others. If PMMA is employed, a locking member 16 having a diameter of approximately 8 mm may be suitable.

As shown in this embodiment, the lock 8 also includes a locking sleeve 24 having an outer diameter or dimension 25*b* and defining a locking bore 25 having a locking bore diameter or dimension 25*a*. The locking sleeve 24 may be made from plastic or any other suitable material. In order to use the locking sleeve 24, a frame bore 36 is defined within a frame side edge 34*a* of a frame 34. As used herein, the term "frame" refers to any suitable member or structure adjacent the closure 32, such as a door frame, door jamb, or a drawer frame. While a cylindrically-shaped frame bore 36 is preferable, and the easiest to form by a user, any suitable frame bore 36 configuration could be used. The frame bore 36 preferably has a frame bore dimension or diameter 36*a* equal or approximately equal to the locking sleeve outer diameter or dimension 25*b* of the locking sleeve 24 such that the locking sleeve 24 may be fixed within the frame bore 36 by any suitable manner, such as via a pressure or friction fit, adhesive or a fastener. When the locking sleeve 24 is installed within the frame bore 36, it is preferable that the locking bore 25 is aligned axially with the stop sleeve bore 15 of the stop sleeve 14 as installed in the closure bore 33 of the closure 32.

The outer locking member outer diameter or dimension 16*a* is smaller than the locking bore dimension or diameter 25*a* such that the locking sleeve 24 can receive the locking member 16 within the locking bore 25. As previously mentioned, the outer diameter or dimension 16*a* of the locking member 16 is preferably smaller than the stop sleeve bore diameter or dimension 15*a* such that the locking member 16 can be moved, such as slideably moved, within the stop sleeve bore 15 from a retracted to an extended position (and vice-versa). In the retracted position, the locking member 16 is disposed within the stop sleeve bore 15 of the stop sleeve 14 such that the locking member does not extend beyond the closure side edge 32*a* and the lock 8 is unlocked. In the extended positon, the locking member 16 is disposed so as to extend beyond the closure side edge 32*a* and into the locking bore 25 such that the lock 8 is locked.

As previously discussed, it is preferable that the locking member 16 be made from a material such that if the locking member 16 is in the extended position, and the lock 8 is locked, the locking member 16 can be broken if a predetermined force, such as a force that could be applied by an adult user, is applied in an effort to open the locked closure 32. In other embodiments, the locking member 16 may include a weakened section or portion that is configured to break if a predetermined force is applied in an effort to open the locked closure 32. For example, the locking member 16 could include a notched or thinner section at a suitable location such that the locking member 16 could be more easily broken at that notched or thinner section. In any event, after the locking member 16 is broken, and because the locking member 16 is preferably detachably connected to the moveable magnet 12, the pieces of the broken locking member 16 can simply be removed from the stop sleeve bore 15 and the locking bore 25. Then, a new locking member 16 having a second detachable fastener member 20 can be inserted into the stop sleeve bore 15 until the second detachable fastener member 20 engages the first detachable fastener member 18 disposed on the end of the moveable magnet 12 such that movement of the moveable magnet 12 will likewise move the new locking member 16.

An actuating magnet 22 may be moved along or in close proximity to the outer surface of the closure 32 adjacent the moveable magnet 12 to operate the lock 8. The actuating magnet 22 may be made of a Neodymium magnetic material or any other suitable magnetic material. The actuating magnet 22 may have any suitable shape, such as the planar circular shape shown in FIG. 1, and may be mounted to or within a magnet handle or knob 23 having any suitable shape. As the actuating magnet 22 is moved near or adjacently along the length of the housing sleeve 10, the actuating magnet 22 magnetically engages the moveable magnet 12 to extend or retract the locking member 16 into a locked or unlocked position relative to the locking bore 25.

To assemble and install the lock 8, two holes, the closure bore 33 and the frame bore 36, may preferably be formed, such as by drilling, in the closure 32 and the frame 34 respectively, so as to be axially aligned when the closure 32 is in a closed position relative to the frame 34. While the bores 33 and 36 may be formed within existing or installed closures 32 and frames 34, they may be also be formed by other suitable means before the closures 32 and frames 34 are installed or assembled, such as in a manufacturing facility where prefabricated closures 32, such as cabinet doors, and frames 34, such as cabinet frames, are manufactured. While it is preferable that the bores 33 and 36 are adjacent to and axially aligned with one another when the closure 32 is in a closed position relative to the frame 34, it is also preferable that the locking bore 25 of the locking sleeve 24 is installed within the frame bore 36 be aligned axially with the stop sleeve bore 15 of the stop sleeve 14 as installed in the closure bore 33.

After forming the bores 33 and 36 in the closure 32 and frame 34 respectively, the housing sleeve 10, together with the moveable magnet 12 (moveably disposed inside the housing sleeve bore 11 such that the first detachable fastener 18 is oriented toward the closure side edge) and the stop sleeve 14 (inserted into the housing sleeve bore 11 so as to retain the moveable magnet 12), may be inserted into the closure bore 33. As discussed, the housing sleeve 10 may be fixed by a press fit or some other suitable means of fastening, including but not limited to using an adhesive, within the closure bore 33. Before or after such installation, the locking member 16 having a second detachable fastener member 20 can be inserted into the stop sleeve bore 15 until the second detachable fastener member 20 engages the first detachable fastener member 18 disposed on the end of the moveable magnet 12.

The locking sleeve 24 may also be fixed within the frame bore 36 by any suitable manner, such as via a pressure or friction fit, adhesive or a fastener. When the locking sleeve 24 is installed within the frame bore 36, it is preferable that the locking bore 25 is aligned axially with the stop sleeve bore 15 of the stop sleeve 14 as installed in the closure bore 33 of the closure 32 such that the locking member can be moved into engagement or disengagement with the locking bore 25.

While the actuating magnet 22 could be used by itself, the actuating magnet 22 may be attached to a magnet handle or knob 23 by any suitable manner, such as via pressure fit, adhesive or a fastener. The actuating magnet 22 may then be used to moveably actuate the moveable magnet 12 to extend and retract the locking member 16. A protective member 26, such as a sticker or plate, may be attached to an exterior surface of the closure 32. The protective member 26 may serve to prevent markings or scratches from occurring as the actuating magnet 22 is moved along the outer surface of the closure 32. The protective member 26 may also serve as a guide to assist a user in determining where on the outer surface of the closure 32 the actuating magnet 22 should be applied to move the moveable magnet 12 and operate the lock 8.

While not shown, in an alternative embodiment, the locking bore 25 having a locking bore diameter or dimension 25*a* could be defined by forming such a locking bore 25 in the frame side edge 34 without using a locking sleeve 24. In such case, the locking bore 25 is preferably aligned axially with the locking member 16 and has a locking bore diameter or dimension 25*a* larger than the outer dimension or diameter 16*a* of the locking member 16 such that the locking bore 25 can receive the locking member 16 in order to lock the closure 32 as previously described.

In another alternative embodiment, while sleeves 10 and 14 are shown to be separate pieces, they could be combined as a single sleeve component. In such case, it might be preferable to have the housing sleeve bore 11 extend through the entire length of the housing sleeve 10 such that the moveable magnet 12 can be installed within the housing sleeve bore 11 before such single sleeve component is installed within the closure bore 33.

In another alternative embodiment, only one sleeve would be utilized. For example, the housing sleeve 10 need not be installed or utilized. If the housing sleeve 10 is not utilized, the stop sleeve 14 alone would be installed in the closure bore 33. In such case, the stop sleeve bore 15 having a stop sleeve bore diameter or dimension 15*a* would moveably receive the locking member 16 while the moveable magnet 12 would be moveably situated within the closure bore 33 and would have a moveable magnet outermost diameter or dimension 12*a* greater than the stop sleeve bore diameter or dimension 15*a* such that the stop sleeve 14 acts as a stop to prevent the moveable magnet 12 from being removed from the closure bore 33.

As another example, a housing sleeve 10 alone could be utilized. In such case, the housing sleeve bore 11 having a housing sleeve bore diameter or dimension 11*a* would moveably receive both the locking member 16 and the moveable magnet 12. In such case, there would be nothing to prevent to moveable magnet 12 from being removed from the housing sleeve bore 11.

As another example, a stop sleeve 14 having an outer diameter or dimension 15*b* greater than the housing sleeve bore diameter or dimension 11*a*, such as a stop sleeve outer diameter or dimension 15*b* equal to the housing sleeve outer diameter or dimension 11*b*, could be used. In such an embodiment, the stop sleeve bore diameter or dimension 15*a* would still be smaller than the housing sleeve bore diameter or dimension 11*a*, such that the moveable magnet 12 could move within the housing sleeve bore 11 but not into the stop sleeve bore 15. In such case, the housing and stop sleeves 10 and 14, with the moveable magnet 12 already within the housing sleeve 14, would be preferably inserted into and fixed in an end-to-end abutting relationship within the closure bore 33 such that the housing and stop sleeve bores 11 and 15 are axially aligned and such that the stop sleeve 14 is nearest the closure edge 32*a* so as to act as a stop and retain the moveable magnet 12 within the housing sleeve bore 11. Otherwise, such an embodiment would operate in conjunction with the other components as previously described.

Furthermore, despite the figures showing the locking sleeve 24 installed in the frame bore 36 and the housing sleeve 10 in combination with the stop sleeve 14 installed within the closure bore 33, the housing sleeve 10 and stop sleeve 14 could alternatively be assembled within an appropriate frame bore 36 and the locking sleeve 24 could alternatively be assembled within an appropriate closure bore 33.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A locking mechanism, for locking a closure having a closure side edge and a closure bore in the closure side edge relative to a frame having a frame side edge and a frame bore in the frame side edge, the locking mechanism comprising:
   - a locking member;
   - a moveable magnet attached to the locking member wherein the moveable magnet and locking member are configured to move within one of the closure bore and the frame bore such that the locking member may be moved so as to engage or disengage the other of the closure bore and frame bore;
   - an actuating magnet configured to magnetically cooperate with the moveable magnet to move the locking member from a disengaged position into an engaged position and vice versa; and
   - a stop sleeve disposed within the one of the closure bore and the frame bore in which the moveable magnet and locking member are situated, wherein the stop sleeve defines a single stop sleeve bore having a single sleeve bore diameter or dimension that moveably receives the locking member and the moveable magnet has a magnet diameter or dimension greater than the single sleeve bore diameter or dimension such that the stop sleeve acts as a stop to prevent the moveable magnet from being removed from the one of the closure bore and frame bore.

2. The locking mechanism of claim 1, wherein the moveable magnet and the locking member are detachably connected to one another such that the moveable magnet may be disconnected from the locking member by a user applying axial force to the locking member without damaging either the moveable magnet or locking member.

3. The locking mechanism of claim 2, wherein the moveable magnet and locking member are detachably connected to one another via a fabric hook and loop fastener.

4. The locking mechanism of claim 1, wherein the locking member is configured to break when in the engaged position if a predetermined force is applied by a user in an effort to open the closure.

5. The locking mechanism of claim 4, wherein the predetermined force has a range between 100 pounds and 150 pounds.

6. The locking mechanism of claim 1, further comprising a housing sleeve disposed together with the stop sleeve within one of the closure bore and the frame bore such that the stop sleeve is nearer to one of the closure side edge or frame side edge respectively, wherein the housing sleeve has a housing sleeve bore having a housing sleeve bore diameter or dimension larger than the single stop sleeve bore diameter or dimension such that the housing sleeve moveably receives the moveable magnet.

7. The locking mechanism of claim 1, further comprising a locking sleeve disposed within the other one of the closure bore and the frame bore, wherein the locking sleeve defines a locking bore adapted to receive the locking member.

8. The locking mechanism of claim 1, further comprising a housing sleeve disposed within the one of the closure bore and the frame bore in which the moveable magnet and locking member are situated, the housing sleeve defining a housing sleeve bore that moveably receives both the locking member and the moveable magnet.

9. A locking mechanism, for locking a closure having a closure side edge and a closure bore in the closure side edge relative to a frame having a frame side edge and a frame bore in the frame side edge, the locking mechanism comprising:

a housing sleeve having a housing sleeve bore disposed within one of the closure bore and the frame bore;

a locking member;

a moveable magnet connected to the locking member wherein the moveable magnet and locking member are configured to move within the housing sleeve bore such that the locking member may be moved so as to engage or disengage the other of the closure bore and frame bore;

an actuating magnet configured to magnetically cooperate with the moveable magnet to move the locking member from a disengaged position into an engaged position and vice versa; and a stop sleeve disposed axially within the housing sleeve bore, wherein the stop sleeve defines a single stop sleeve bore having a single stop sleeve bore diameter or dimension that moveably receives the locking member while the moveable magnet has an outermost magnet diameter or dimension greater than the single stop sleeve bore diameter or dimension such that the stop sleeve acts as a stop to prevent the moveable magnet from being moved from the housing sleeve.

10. The locking mechanism of claim 9, wherein the moveable magnet and the locking member are detachably connected by a fabric hook and loop fastener, such that the moveable magnet may be disconnected from the locking member by a user applying axial force to the locking member without damaging either the moveable magnet or locking member.

11. The locking mechanism of claim 9, wherein the locking member is configured to break when in the engaged position if a predetermined force is applied by a user in an effort to open the closure.

12. The locking mechanism of claim 11, wherein the predetermined force has a range between 100 pounds and 150 pounds.

13. The locking mechanism of claim 9, further comprising a locking sleeve disposed within the other one of the closure bore and the frame bore, wherein the locking sleeve defines a locking bore adapted to receive the locking member.

14. A locking mechanism, for locking a closure having a closure side edge and a closure bore in the closure side edge relative to a frame having a frame side edge and a frame bore in the frame side edge, the locking mechanism comprising:

a housing sleeve having a housing sleeve bore;

stop sleeve defining a single stop sleeve bore having a single stop sleeve bore diameter or dimension, the stop sleeve being disposed axially within the housing sleeve, the stop sleeve and housing sleeve being together disposed within the one of the closure bore and the frame bore such that the stop sleeve is nearer to other of the closure bore and the frame bore;

a moveable magnet configured to move within the housing sleeve bore a locking member configured to move within the housing sleeve bore and the single stop sleeve bore, the locking member attached to the moveable magnet such that movement of the moveable magnet will cause the locking member to move so as to engage or disengage the other of the closure bore and frame bore, and wherein the moveable magnet has an outermost magnet diameter or dimension greater than the single stop sleeve bore diameter or dimension such that the stop sleeve acts as a stop to prevent the moveable magnet from being moved from the housing sleeve; and an actuating magnet configured to magnetically cooperate with the moveable magnet to move the locking member from a disengaged position into an engaged position and vice versa.

15. The locking mechanism of claim 14, wherein the moveable magnet and the locking member are detachably connected by a fabric hook and loop fastener, such that the moveable magnet may be disconnected from the locking member by a user applying axial force to the locking member without damaging either the moveable magnet or locking member.

16. The locking mechanism of claim 14, wherein the locking member is configured to break when in the engaged position if a predetermined force is applied by a user in an effort to open the closure.

17. The locking mechanism of claim 16, wherein the predetermined force has a range between 100 pounds and 150 pounds.

18. The locking mechanism of claim 14, further comprising a locking sleeve disposed within the other one of the closure bore and the frame bore, wherein the locking sleeve defines a locking bore adapted to receive the locking member.

* * * * *